US007730622B2

(12) United States Patent
McCauley

(10) Patent No.: US 7,730,622 B2
(45) Date of Patent: Jun. 8, 2010

(54) STRUCTURAL SURFACE MEASURING AND ALIGNING APPARATUS AND METHOD

(76) Inventor: Kerry McCauley, 30 John St., Lodi, NJ (US) 07055

( * ) Notice: Subject to any disclaimer, the term of this patent is extended or adjusted under 35 U.S.C. 154(b) by 244 days.

(21) Appl. No.: 11/498,664

(22) Filed: Aug. 2, 2006

(65) Prior Publication Data

US 2008/0028693 A1 Feb. 7, 2008

(51) Int. Cl.
*E04F 21/00* (2006.01)
*E04B 2/82* (2006.01)

(52) U.S. Cl. ..... 33/194; 33/667; 33/613; 33/464

(58) Field of Classification Search ..... 33/194, 33/196, 197, 613, 645, 562, 667, 464, 482, 33/404, 411
See application file for complete search history.

(56) References Cited

U.S. PATENT DOCUMENTS 2,579,386 A * 12/1951 Koenig ..... 33/562
2,846,772 A * 8/1958 Strausser ..... 33/342
3,068,581 A 12/1962 Skalwold et al.
3,903,671 A 9/1975 Cuin et al.
4,070,835 A 1/1978 Reverend et al.
4,106,204 A * 8/1978 Schader ..... 33/795
4,345,380 A * 8/1982 Vis ..... 33/784
4,497,115 A * 2/1985 Dearman ..... 33/529
4,507,872 A 4/1985 Schermann
4,625,481 A 12/1986 Crandell
4,635,370 A * 1/1987 Beaver ..... 33/558.01
4,829,727 A * 5/1989 Kuzara, Jr. ..... 52/127.2
4,922,622 A * 5/1990 Galloway ..... 33/542
5,167,073 A * 12/1992 Stein ..... 33/194
5,385,050 A * 1/1995 Roberts ..... 73/597
5,655,343 A * 8/1997 Seals ..... 52/217
5,775,036 A * 7/1998 Stanley, Sr. ..... 52/127.2
D411,808 S * 7/1999 Irwin ..... D10/65
6,237,233 B1 * 5/2001 Cloutier et al. ..... 33/194
6,405,501 B1 * 6/2002 Cerrato ..... 52/217
6,470,647 B2 10/2002 Hsueh
6,807,777 B2 * 10/2004 Wagner et al. ..... 52/204.1
6,834,439 B2 * 12/2004 Matsumiya et al. ..... 33/706
6,966,119 B1 * 11/2005 Dlugoleski ..... 33/194
7,100,298 B2 * 9/2006 Kiwada et al. ..... 33/613
7,159,328 B1 * 1/2007 Duda ..... 33/647
2002/0069541 A1 * 6/2002 Sumner ..... 33/194
2002/0095811 A1 * 7/2002 Lynch ..... 33/613
2003/0145531 A1 * 8/2003 Holder ..... 52/98
2003/0204961 A1 * 11/2003 Sumner ..... 33/194
2004/0000061 A1 * 1/2004 Tuthill ..... 33/194

(Continued)

*Primary Examiner*—Yaritza Guadalupe-McCall
(74) *Attorney, Agent, or Firm*—Jordan and Hamburg LLP

(57) ABSTRACT

An apparatus and method provide for measurement at various positions over an extent of an uneven structural surface, and preparation of spacers, cut to appropriate thicknesses based upon such measurements, such that when affixed to the respective measurement locations, outer facing surfaces of the spacers are collectively coplanar. A method of aligning a surface includes defining a reference plane in a fixed condition relative to the structural surface, and determining a differential distance between the structural surface and the reference plane at various locations along an extend of the particular structural surface. Using these measurements, indexed according to location, spacers are cut to a thickness based upon the respective differential distances at corresponding locations, which, when mounted to the structural surface at these recorded locations, results in alignment of outwardly facing surfaces with a common plane. Advantageously, at least a portion of the processes is automated.

22 Claims, 9 Drawing Sheets

U.S. PATENT DOCUMENTS

2005/0055952 A1 3/2005 McGonigal
2005/0081400 A1 * 4/2005 Matsumiya et al. ..... 33/706
2005/0120648 A1 * 6/2005 Gorman ..... 52/204.5

* cited by examiner

STRUCTURAL SURFACE MEASURING AND ALIGNING APPARATUS AND METHOD

BACKGROUND OF THE INVENTION

The invention relates to a structural surface alignment apparatus and method, and more particularly, to a method and apparatus by which spacers can be prepared for attachment to an uneven wall, or other surface or sub-surface, in an organized fashion, to collectively align outwardly facing surfaces of the spacers in a coplanar condition when attached to such surface, so as to allow facilitated mounting of an object having a generally planar confronting surface to the structure or other surface in a stable manner, with the mounted spacers interposed therebetween.

In order to securely apply sheet rock, wall board, paneling, cabinetry, door frames, wood panels, stone, marble firing strips, mechanical fasteners (such as aluminum Z-clips, or the like, to a wall or other receiving structure in a stable and secure manner, it is desirable to first provide an aligned, planar mounting surface. It is well known that many existing building structures provide less than perfectly aligned surfaces and which deviate significantly from true planar configuration. Therefore, the process of mounting fixtures, paneling, and the like, thereto is often a challenging and time consuming endeavor, as the surface, such as vertical wall, often varies to a meaningful extent from a true planar or vertical state, by consequence of previous, less than perfect, construction. Similarly, hanging door frames can also be troublesome, as the opening must first be made square and plumb.

The prior art has not heretofore adequately addressed the above issues, and has failed to provide a fully satisfactory solution for allowing construction to proceed, or be implemented, in a manner permitting facilitated preparatory alignment of a surface for attachment thereto of an installed fixture, such as the aforementioned sheet rock, paneling, cabinets, door frames, etc.

It would therefore be desirable to provide a method and apparatus for preparing spacers for placement along a surface according to preceding measurements which, when same were affixed to the surface at organized locations and spacing, would result in collective outwardly facing surfaces of the spacers being generally aligned in a common plane. A fixture having a planar surface could then be easily attached to the surface by being supported in assured contact with each of the spacers over an entire confronting extent thereof.

It would be yet more desirable to provide such method and apparatus in a form which is suitably mobile for transport to various building sites and relocation on site, and which would be versatilely adaptable for a wide range of mounting applications.

Accordingly, it is an object of the invention to provide a method and apparatus for use in aligning a mounting surface which overcomes the drawbacks of the prior art.

It is a further object of the invention to provide a method and apparatus for use in use in aligning a mounting surface which readily permits practice of the method at various locations, and which is suitable for varied applications, including installation of wall board, paneling, cabinets, wall units, etc.

It is still a further object of the invention to provide a method and apparatus which is easy to implement in practice in a time-saving, reliable and non-labor intensive manner.

SUMMARY OF THE INVENTION

In accordance with these and other objects of the invention, there is provided an apparatus and method, in accordance with which, an unevenness of a wall or other attachment surface, such a door or window rough opening can be readily measured at various positions over its extent, and spacers cut to appropriate thicknesses based upon such measurements, such that when affixed to the respective measurement locations, outer facing surfaces of the spacers collectively lie on a same plane (i.e., the surfaces of the spacers, when mounted to the subject surface, are mutually coplanar). The terms "spacers" as used herein are defined as applying synonymously with the alternative term of art "shims," used commonly in construction, and the process of applying the referred to spacers to a structural surface, as "shimming."

Briefly stated, a method of aligning a surface includes defining a reference plane in a fixed condition relative to the structural surface, and determining a differential distance between the structural surface and the reference plane at various locations along an extend of the particular structural surface. Using these measurements, indexed according to location, spacers are cut to a thickness corresponding to the respective differential distances, which, when mounted to the structural surface at the recorded locations, results in alignment of outwardly facing surfaces with a common plane.

An apparatus for practicing this method includes a reference portion fixable in space relative to the structural surface upon which the reference plane positioned relative to the structural surface is defined, and a measurement portion mounted to the reference portion such that the measurement portion is locatable at positions along the structural surface at which the spacers are to be mounted. The measurement portion is advanceable and retractable relative to the structural surface, and includes a confronting front surface contactable with the structural surface when advanced. A distance sensor indicating a distance of travel between a position in which the confronting front surface is in contact with the structural surface, and another position having a fixed relationship with the reference plane to which the measurement portion is retracted is provided, and based upon these distance measurements, the spacers can be prepared for mounting. Advantageously, the apparatus, regardless of a particular structural form selected, is electronically automated.

According to an embodiment of the invention, a measurement apparatus comprises a gantry to which one or more measurement devices can be mounted for indexed movement relative to a structure to which it is held at a fixed position. The gantry is maintainable in a secured state to the structural surface which is to be aligned such that reference measurements relative thereto can be taken. The gantry and associated elements comprises a gantry system generally including a frame extending in X and Y-axes, and a Z-axis guide movably mountable to the frame such that it can be located at virtually any point along a surface being aligned. For example, the Z-axis guide can be slidably mounded to a Y-axis guide for vertical movement therealong, and the Y-axis guide being in turn movable horizontally along the X-axis. A measurement portion included as part of the Z-axis guide, conveniently in the form of a read head, is movable to contactingly engage the structural surface being aligned. Movement between the contact position of the read head and a reference plane related to a desired plane along which the spacers will be coplanar is measured, advantageously by a linear displacement transducer probe, and later used as a basis for a thickness of spacers produced by a cutting apparatus in subsequent step, for mounting at the various measurement positions.

Another embodiment can be used to align parallel facing surfaces using the 3-axis X-Y-Z gantry system referred to above, or alternatively used in a 2-axis Y-Z configuration for measuring door openings for spacers. An additional read head is mounted on a opposite end of the Z-axis guide and a distance is advantageously set between the leading ends (wall confronting surfaces) of the read heads representative of a required width between spacers. Use of such system assures that not only that the facing surfaces will be rendered parallel, but also that they will be separated by an appropriately selected distance, for installation of, for example, a door frame of a fixed outside width.

A further embodiment according to the invention is directed to 2-axis measuring device used, for example, in an application directed to shimming lower cabinets level next to a wall. The device includes a straight edge main member serving as a single axis reference surface from which to measure relative thereto. An adjustable read head member serves as a measurement portion which is set in a "zero" position when a leading end thereof is aligned with the straight edge surface of the main member. Differential distance measurements between this point and a point of contact with the surface to be aligned represents the desired spacer thickness.

Another advantageous embodiment is directed to a portable device for taking hand-held measurements representative of differential distances between a reference plane spaced apart from a structural surface and local positions along a structural surface. The device includes a body having a reference plate provided at an end thereof presenting a leading end surface for contacting a structural surface. A measurement portion in the form of a read head member is slidable relative thereto, and can be advanced in a direction for contacting the structural surface, and withdrawn to a reference plane indicated by a straightedge, string, laser, etc. The distance of travel between these two points is measured and is representative of spacer thickness.

An automated system for cutting spacers (shims) in accordance with data measurement taken, for example, by the above discussed gantry system or the other described measurement devices, sizes spacers by use of a stepper or servo powered positioning system, which sets a gate at a carefully measured distance from a leading edge of a saw blade based upon the previously obtained differential distance measurements.

The above, and other objects, features and advantages of the present invention will become apparent from the following description read in conjunction with the accompanying drawings.

DETAILED DESCRIPTION OF THE PREFERRED EMBODIMENT

Before describing various preferred embodiments of the invention in detail, it should be noted that the inventive approach involves two distinct operations, including a first operation by which measurement of differential distances is made, upon which respective thicknesses of spacers to be installed to the corresponding measurement locations are based, and another operation by which the spacers are cut according to the collected data. Since the cutting is applicable to each of the various device embodiments for taking of measurements described herein, a description of an automated cutting method and apparatus will follow a description of the measurement embodiments.

Notwithstanding the above, respective description of measurement and cutting operations may overlap in the disclosure that follows, insofar as it may be necessary for an understanding of the obtaining of measurement data to reference the cutting method and apparatus before a detailed description of the cutting operation has been given. It is noted, therefore, in advance, that FIGS. 1-11 are directed to measurement aspects of the invention, and FIG. 12 depicts an automated system for cutting the spacers in accordance with data measurement aspects of the invention.

Referring now to FIGS. 1-5, an embodiment directed to an apparatus for aligning a structural surface for preparation in applying paneling, etc. thereto, is advantageously provided in a form including a gantry system for taking measurements along the mounting surface, depicted generally at 10. A vertical wall 12 serves as the structural surface in the depicted example. For purposes herein, the supporting framework of the gantry system 10 extends in an expanded dimension in X (width) and Y (height) axes, and a distance of the gantry system 10 from the structural surface (e.g. wall 12) is defined as the Z-axis.

The gantry system 10, when in use, obtains data for preparing spacers 14, which, when applied to the structural surface in mounting positions corresponding to the data collection positions, such as along the wall 12 in the depicted example, results in outwardly facing surfaces of the spacers 14 being aligned in a common plane (thereby collectively providing a number of arrayed coplanar mounting surfaces).

Figure 1:
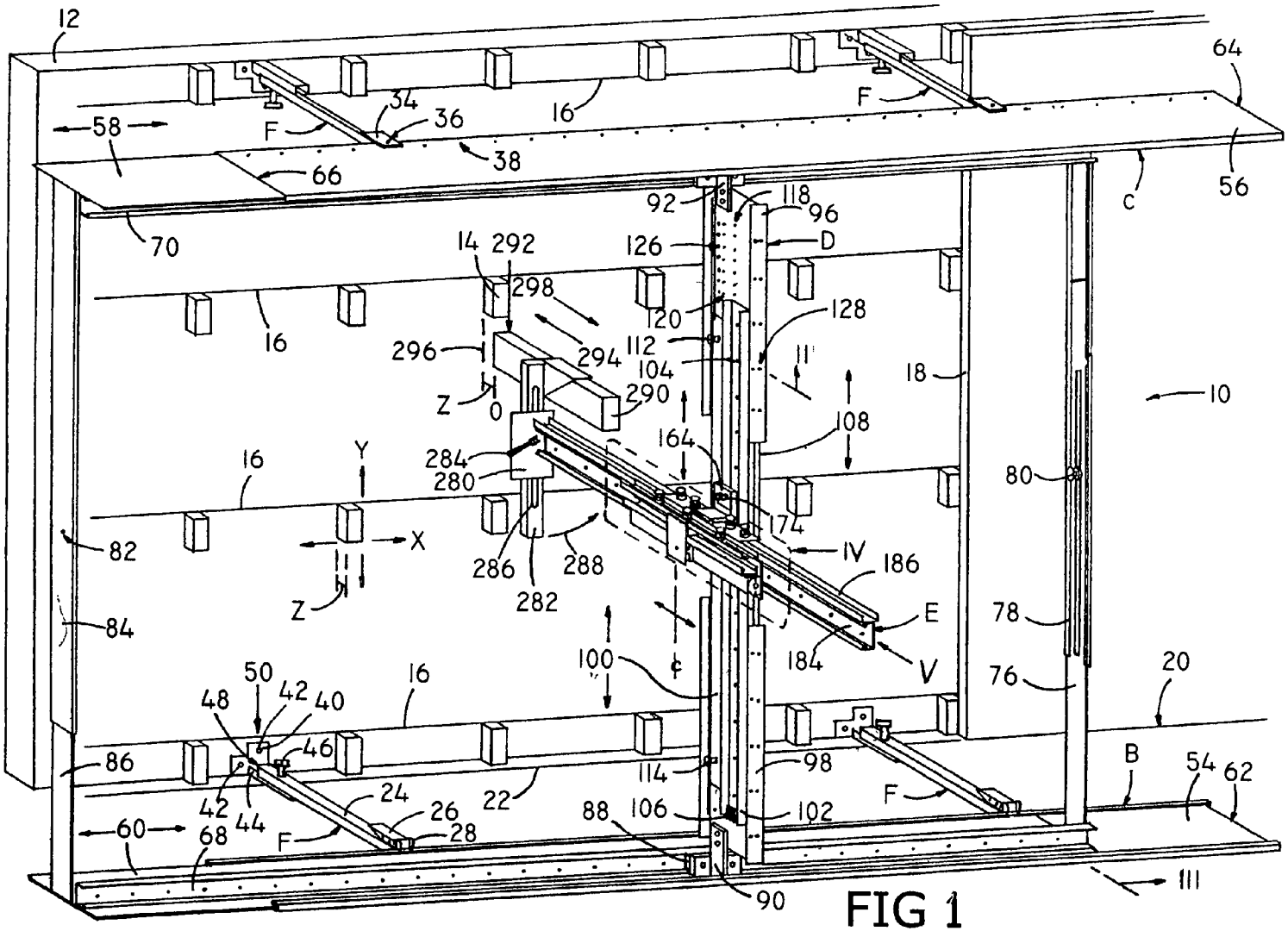
FIG. 1 is a perspective front view of a measurement apparatus provided in the form of a gantry system in accordance with an embodiment of the invention.

FIG. 1 shows the spacers 14 after they are cut by an apparatus and method described below herein with reference to FIG. 11, and installed on the wall 12, conveniently in rows arranged along horizontal layout lines 16. The spacers 14, which are measured for the correct size at each mounting location by the apparatus and method according to the invention, advantageously align with X and Y-axes (horizontal and vertical in the present example), collectively providing a planar attachment network for contact engagement thereto of materials having a generally planar contact surface, such as, for example, wood paneling 18, in the example. The correct sizing of the spacers 14 in the Z-axis direction (i.e., a thickness of each of the spacers 14) based upon the aforementioned collected measurements, provides collectively flat (i.e. planar) engagement surfaces for receiving paneling 18 which allows for aligned support over a horizontal and vertical extent of the latter. As shown in FIG. 1, the surface 20 of paneling 18 after installation aligns with a chalk line 22 on the floor, which represents the intended layout/location of the paneling 18.

In practice, and in furtherance of the disclosed method, the gantry system 10 is maintained in a fixed reference location relative to the wall 12, for example, by being secured to the wall 12, and aligned parallel to the predefined and placed (snapped) reference chalk line 22 on the floor, and parallel to the vertical Y-axis (plumb), conveniently by means of brackets F. The distance from the wall at which the reference chalk line 22 should be placed is conveniently determined by the user after an estimate is made of total expected Z-axis variation of the existing wall 12 over its extent. An additional distance is added to the maximum estimated wall variation to assure that even at the highest variation in the Z-direction (furthest out from a remainder of the wall 12), a spacer of suitable thickness can be applied in such position and still be in alignment with other spacers. In the depicted example of FIG. 1, since the chalk line 22 aligns with the installed wood paneling 18, the thickness of the wood paneling 18 is additionally added into the aforementioned calculation.

Advantageously, in practice, the brackets F are fastened to the wall 12 in suitable fashion prior to installation of a remainder of the gantry system 10, for example, by screws which extend through holes 42 in wall plates 40. This preliminary installation allows multiple workers on a job site to prepare various locations by pre-installing brackets F in advance of installation of the gantry system 10, such that the gantry system 10 can later be moved to each selected location for facilitated mounting to the already installed brackets F, thereby allowing immediate taking of wall measurements subsequent to such attachment. Conveniently, a T-channel 44 is used, and a fastener knob 46 engages T-channel 44 to align the leading edge of 24. An arrow 50 in FIG. 1 points to the end of a bracket 48 which, when aligned with chalk line 22, indicates mutual alignment of the bracket 48 and chalk line 22. Thus, when gantry system 10 is later fixed to the brackets F, at least a bottom part of the gantry system 10 will be rendered parallel with the chalk line 22, assuming use of same length brackets F.

As noted above, first the brackets F are installed, and then the gantry system 10, once assembled, is placed and attached to the brackets F. The gantry system 10 is then checked for parallel at a bottom thereof, relative to wall 12 (or other attachment structure), and if necessary adjusted. While no specific order of steps is deemed essential, conveniently, for example, bottom outer channel 54 is first adjusted, if necessary, to be parallel to chalk line 22. The gantry system 10 is then rendered plumb (true vertical) by locating plain y-axis on a main Y-axis guide D near each top bracket F, and then, by placing a level or plumb bob on main guide D, the brackets are adjusted according to the level or plumb bob (not shown).

In practice, construction sites vary dimensionally to a significant degree. For example, while one wall may be 8 feet in height, another may be 12 feet or greater. In addition, an area to be shimmed (aligned) can extend over a wide range of distances. Moreover, it is quite possible that the gantry system 10 will have to be moved from one room or area to another through a doorway, invariably of reduced height relative to the work areas in each room. Therefore, in order to increase the versatility and adaptability of the gantry system 10 of FIGS. 1-5, it is considered particularly advantageous to equip such system with the ability to expand and contract in the X and Y-axes, such that it can be readily adapted to use in virtually any environment.

The embodiment depicted in FIG. 1 illustrates just one preferred example of many structural possibilities of achieving such goal. In this advantageous example, in order to allow for vertical adjustment of the framework of gantry system 10, height-adjustable bilaterally located vertical braces, respectively comprising mutually cooperative slide members 76, 78 and 86, 84, are provided. The slide members 76, 78 and 86, 84 of each of the vertical braces are moved relative to on another to extend same to a desired height, and are then fixed relative to one another by suitable means, such as, for example, each by a respective screw-type adjustment knob 82, 80.

Relating to X-axis expansion and contraction, the depicted example includes bottom and top main X-axis guides B, C, conveniently comprising respective inner guides 60, 58 slidable in two directions (shown by arrows), each which travels in, and is guided by, a respective outer channel 54, 56. Inner guides 60, 58 are extendable past the ends 62, 64, 66 of outer channels 54, 56 of main X-axis guides B, C. The slide members 76, 78 and 86, 84 of the respective vertical braces are attached to respective top and bottom inner guides 60, 58, such that the entire frame of gantry system 10, which is comprised of the vertical braces 76, 78 and 86, 84 and the bottom and top main X-axis guides B, C, is movable back and forth in the X-axis direction, and past the ends 62, 64, 66 of outer channels 54, 56 of main X-axis guides B, C. Brackets F attach to outer channels 54,56, fixing same to the wall 12.

Main Y-axis guide D extends vertically between the bottom and top main X-axis guides B, C. Main Y-axis guide D is mounted via X-Y axis connector brackets 90, 92, each to a linear guide slider 88 (for example REDI-RAIL, produced by Pacific Bearing, Rockford, Ill.), which rides in top and bottom main X-axis linear guide rails 70, 68 mounted to inner guides 60, 58, such that main Y-axis guide D is movable in the X-axis direction over a full range of travel between vertical braces 76, 78 and 86, 84. By virtue of such arrangement, main Y-axis guide D can be located horizontally anywhere along wall 12, and is not strictly limited to travel within a width expanse between vertical braces 76, 78 and 86, 84 of the frame of gantry system 10.

Figure 3:
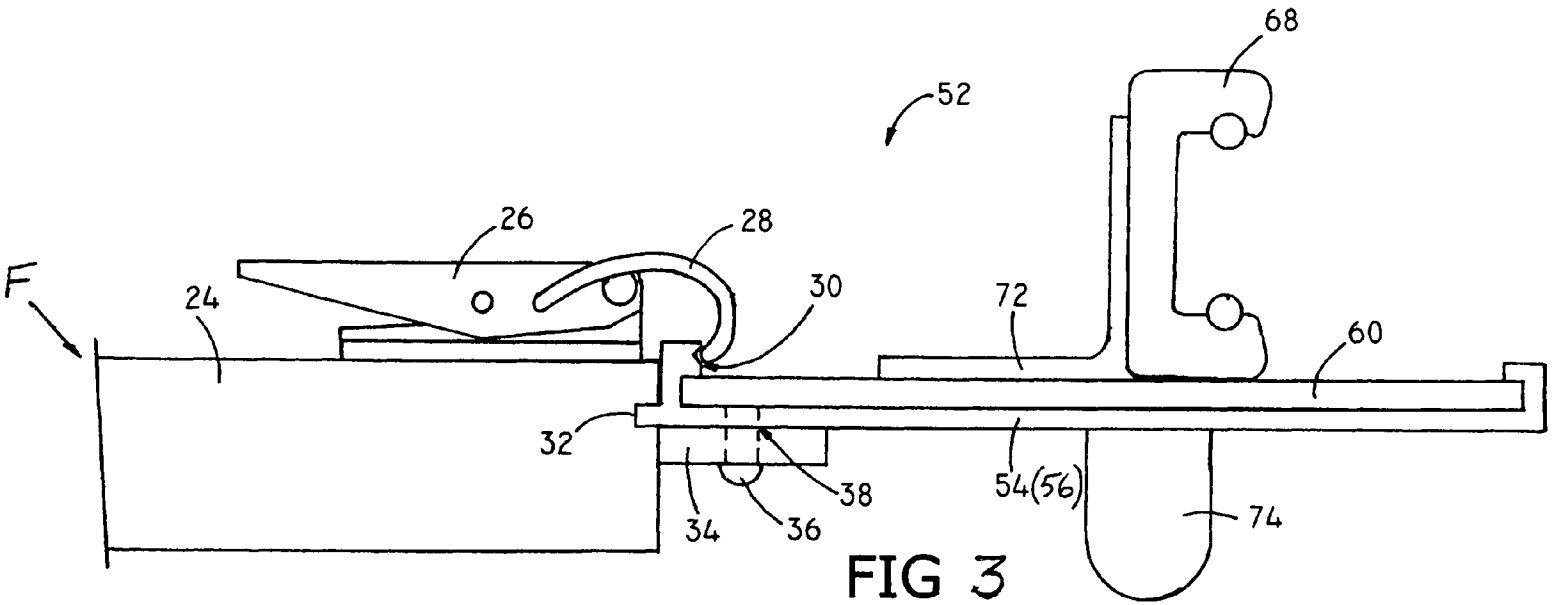
FIG. 3 is a detail view of a portion of the apparatus of the embodiment of FIG. 1 shown in partial cross-section depicting a quick release attachment feature for fixing the gantry system to mounted brackets taken at line III.

Referring to FIG. 3, a detail of bracket F and main X-axis guides 60, 54 is shown, generally designated 52, and which advantageously includes a quick release feature for connection with gantry system 10. FIG. 3 is applicable to both top and bottom attachments. A main body 24 of bracket F engages the outer channel 54 via a flange at an edge of outer channel 54 and a notch 32 at the end of main body 24. The connection of flange with notch 32 is held together by a toggle latch 26 which engages a V-notch 30 on outer channel 54 via a clip 28. A tab 34 can conveniently be used to attach the top brackets F to top outer channel 56 via screws 36 put into threaded holes 38 of 56. An angle 72 conveniently secures main X-axis linear guide rails 68 (70) to main X-axis guides 60, 54 (and 58, 56). A wood or rubber (or other suitable material) keel 74 is provided to lift and balance outer channel 54 off the ground.

Returning to FIG. 1, a main Z-axis guide E is slidably attached to main Y-axis guide D, allowing vertical positioning of the main Z-axis guide E, the details of which are described below. A read head 290 is carried on an end of main Z-axis guide E for taking measurements of wall deviations. Read head 290 is advantageously connected to Z-axis linear guide rail 184 via swivel bracket assemblies 280, 282, 284. Arrow 288 indicates 360° swivel of read head 290.

In order to allow the read head to access and measure at virtually any position along a surface to be aligned, such as a wall 12 in the present example, a full range of vertical motion of main Z-axis guide E is deemed advantageous. However, since the gantry system 10 is height-adjustable, as described above, a single track of fixed length on which main Z-axis guide E could travel between the top and bottom main X-axis guides B, C, is not feasible.

Figure 2:
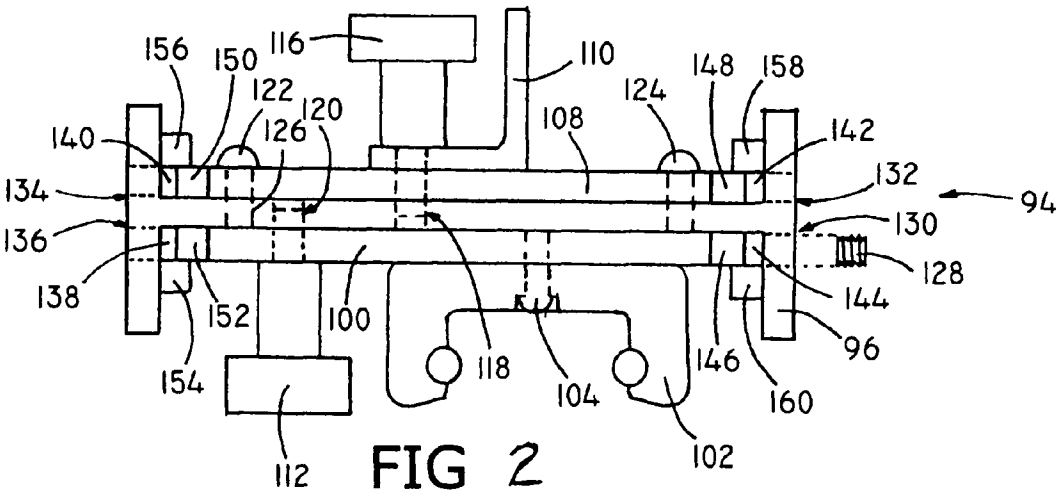
FIG. 2 is a detail cross-sectional view taken on line II of FIG. 1 of the main Y-axis guide of the embodiment of FIG. 1.

Therefore, advantageously, a mechanism which could allow for height adjustability of main Y-axis guide D, while concomitantly avoiding restriction of slidable travel of main Z-axis guide E along a full length of main Y-axis guide D, is advantageously provided. Referring to FIG. 2 (cross-sectional view taken at line II of FIG. 1, generally designated 94) in conjunction with FIG. 1, such a mechanism is provided, for example, in the form of a slide mechanism mounted to another slide mechanism.

Main Y-axis guide D is comprised of four major parts (shown in FIGS. 1 and 2), i.e., top and bottom I-beams 96,98, inner guide 100, and stabilizer 108. A linear guide rail 102 (such as a linear guide rail produced by REDI-RAIL, produced by Pacific Bearing, Rockford, Ill.) is attached to inner guide 100, conveniently via screws 104. A rubber bumper 106 (FIG. 1) advantageously functions as a stop for a main connector bracket 164 to rest upon at the bottom of linear guide rail 102. Locating pins 114, 112 engage a pair of holes 120 allowing inner guide 100 to be positioned and held in place to I-beam 96,98.

Stabilizer 108 serves as a "back bone" which is adjusted to extend and stabilize I-beams 96, 98. Locating pins 116 (FIG. 2) engage pin holes 118 to maintain a desired extension. Screws 122, 124 which engage threaded holes in I-beams 96, 98 secure stabilizer 108 to I-beams 96, 98.

This configuration of I-beams 96, 98, so extended and aligned, allows an extended channel for movement of inner guide 100 and stabilizer 108 in the Y-axis direction.

As seen in FIG. 2, steel members 146, 148, 150, 152 are provided that attach to the edges of slidable inner guide 100 and stabilizer 108, the latter which are advantageously aluminum. The edges of the steel members 146, 148, 150, 152 provide hardened edges which are ground parallel. Guide ways 138, 140, 142, 144 are also advantageously steel, and travel with top and bottom I-beams 96, 98. Threaded holes 130, 132, 134, 136 are advantageously provided in I-beams 96, 98, each for receiving allen screws 128 which engage guide ways 138, 140, 142, 144 for adjustment of parallelism of I-beams 96, 98. An angle 110 attached to stabilizer 108 advantageously helps to maintain rigidity. Strips 154, 156, 158, 160 attached to I-beams 96, 98 retain slidable inner guide 100 and stabilizer 108 to I-beams 96, 98.

It is noted that other, alternative designs, may instead use a bearing system, replacing guide ways 138, 140, 142, 144.

Figure 4:
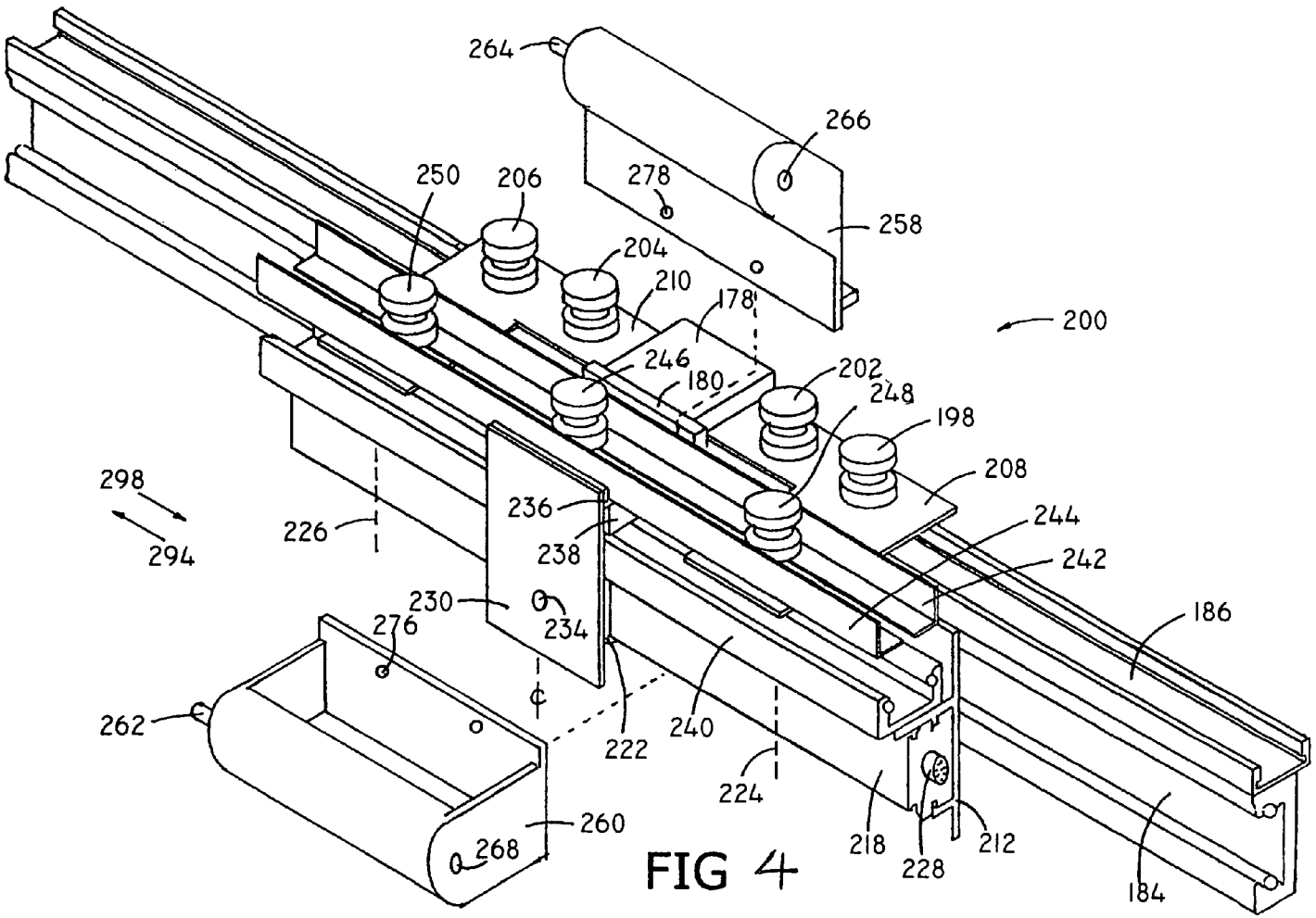
FIG. 4 is a detail view of the section demarcated by dotted lines and identified as numeral IV in FIG. 1.
Figure 5:
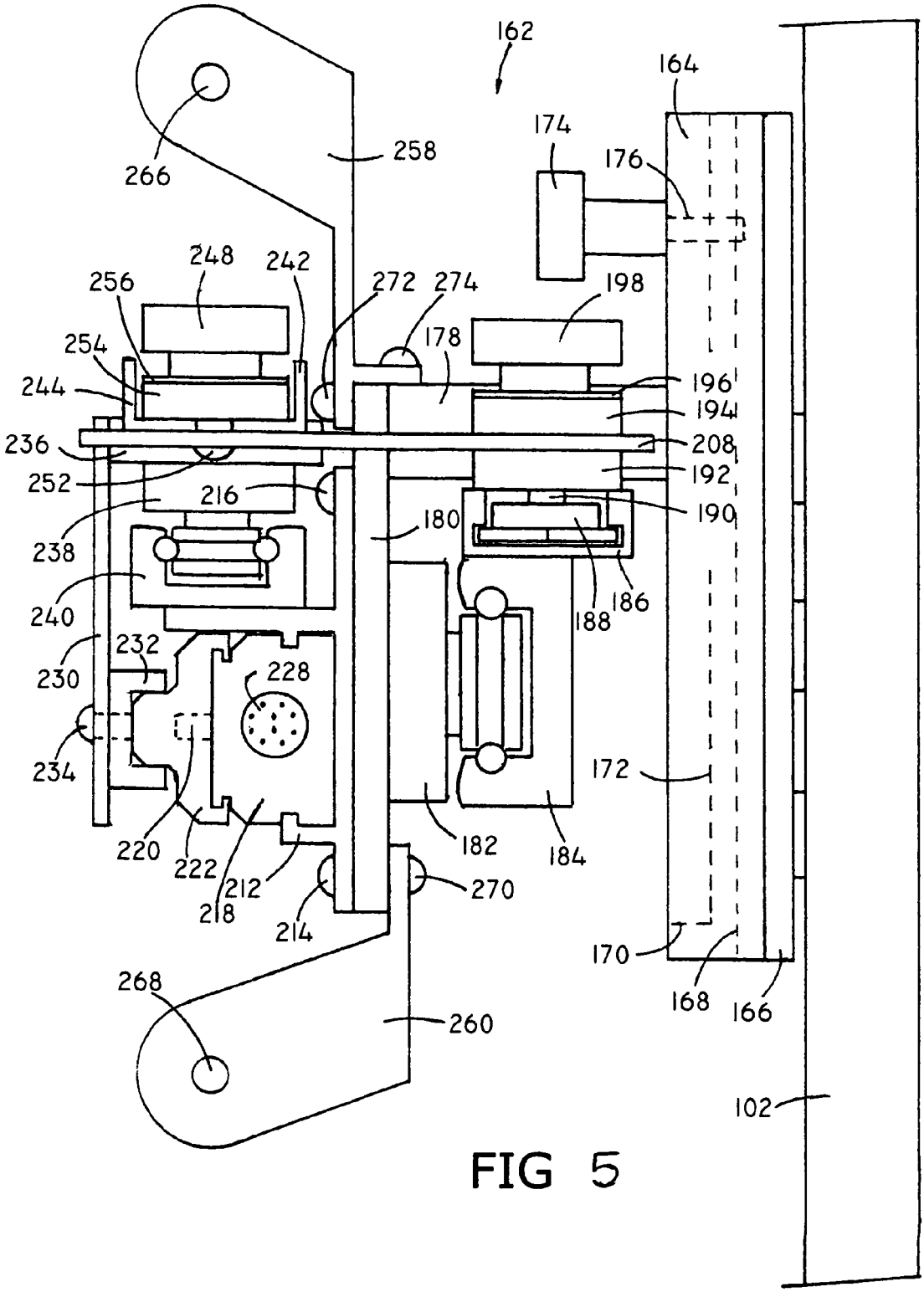
FIG. 5 is an end view of the detail view of FIG. 4 taken in a direction of arrow V in FIG. 1.

Turning now to FIGS. 4 and 5, a partially exploded detail view (designated 200 in FIG. 4) and an end-view of Z-axis main guide E and Y-axis linear guide rail 102 (identified by arrow V in FIG. 1 and shown generally at 162 in FIG. 5), is shown. A linear guide slider 166 (such as, the general type as REDI-RAIL, produced by Pacific Bearing, Rockford, Ill.) slidably connects a main connector bracket 164 to linear guide rail 102. As will be understood, since the above construction allows inner guide 100 to be moved to higher or lower positions by reorientation thereof with respect to I-beams 96, 98, and since linear guide rail 102 is mounted to inner guide 100, a full range of vertical travel of main Z-axis E, slidably mounted in turn to linear guide rail 102 via linear guide slider 166 which rides along a length of linear guide rail 102, is realized.

The dotted lines in FIG. 5, labeled 166, 170, 172, show a flange plate connecting linear guide slider 166 to a slot in main connector bracket 164, which allows the main connector bracket 164 to slide over flange 168, 170, 172. A locating pin 174 engages a pin section 176 into a hole in the flange 168, 170, 172, securing main connector bracket 164 to linear guide slider 166. A Z-axis linear guide slider 182 is carried on a bridge plate 180 attached in turn to a bridge/stop member 178. A pair of handles 258, 260 are optionally provided, and are attached to bridge/stop member 178 and bridge plate 180, conveniently via screws 270, 272, 274 extending through holes 276, 278. Handle 258 advantageously includes a learn button 264 and a hole 266 for wiring same, and similarly, handle 260 includes another learn button 262 and a wiring hole 268, the function of which will be described below.

Z-axis linear guide slider 182 rides in a Z-axis linear guide rail 184, thereby slidably connecting main connector bracket 164 with Z-axis linear guide rail 184, and thus establishing an Y-Z main axis connection. A T-channel 186 is connected to Z-axis linear guide rail 184. A T-nut assembly 188, 190, 192, 194, 196, 198 engages T-channel 186 and connects and controls the interaction of Z-axis linear guide rail 184 and T-channel 186, with stop plates 208 and 210 (FIG. 4).

As shown in FIG. 4, fastener knobs 198, 202, 204, 206 are provided, which, when are all are tightened, secure stop plates 208, 210 against bridge/stop member 178, and control movement of 184, 186 for positioning in the Z-axis direction. A linear displacement transducer probe 218 (for example of the magnetostrictive type produced by Ametec, Clawson, Mich.), which is part of an electronics mount 212, is fixed to bridge plate 180 conveniently via screws 214, 216 (FIG. 5), and thus remains in a fixed Z-axis position irrespective of movement of main Z-axis guide E. The magnet 220 is housed in a plate slide magnet assembly 222, which is in turn held by a channel member 232 attached to a plate 230, conveniently by a screw 234. Plate 230 is connected to a saddle 236 which in turn connects below to a linear guide slider 238, which rides in a linear guide rail 240 to advantageously stabilize motion and travel. Probe 218 therefore monitors a magnet 220 as magnet 220 travels, relative thereto, between lines 224, 226, which is the read area of the probe 218.

A pair of angle motion transfer members 242, 244 are interposed between fastener knobs 250, 246, 248 and stop plate 210, saddle 236, and stop plate 208, respectively, and serve to transfer motion between linear guide rail 184 and stop plate 210, saddle 236, plate 230 and stop plate 208, when the fastener knobs are tightened down against the angle motion transfer members 242, 244. It is noted that reference designators 252, 254 and 256 represent a screw and 2 washers, respectively, serving as part of a T-nut connector which includes fastener knob 248.

Since magnet assembly 222 (FIG. 4) is mounted to plate 230, which is in turn fixed to linear guide rail 184 via angle motion transfer members 242, 244, magnet 220 travels along with plate 230 the same distance as the leading end 292 of read head 290, which is also equal to the desired thickness of the spacer 14. The probe 218, which reacts to the linear movement of magnet 220, monitors this distance and communicates to a programmable linear controller (PLC) via a 10 pin connector 228, using for example, quadrature protocol.

The PLC functions to record data representative of measurement displacement on registers conveniently in order of the measurements at the different locations, and then to control the stepped or servo powered positioning system, described in greater detail below, utilizing the stored data.

Figure 6:
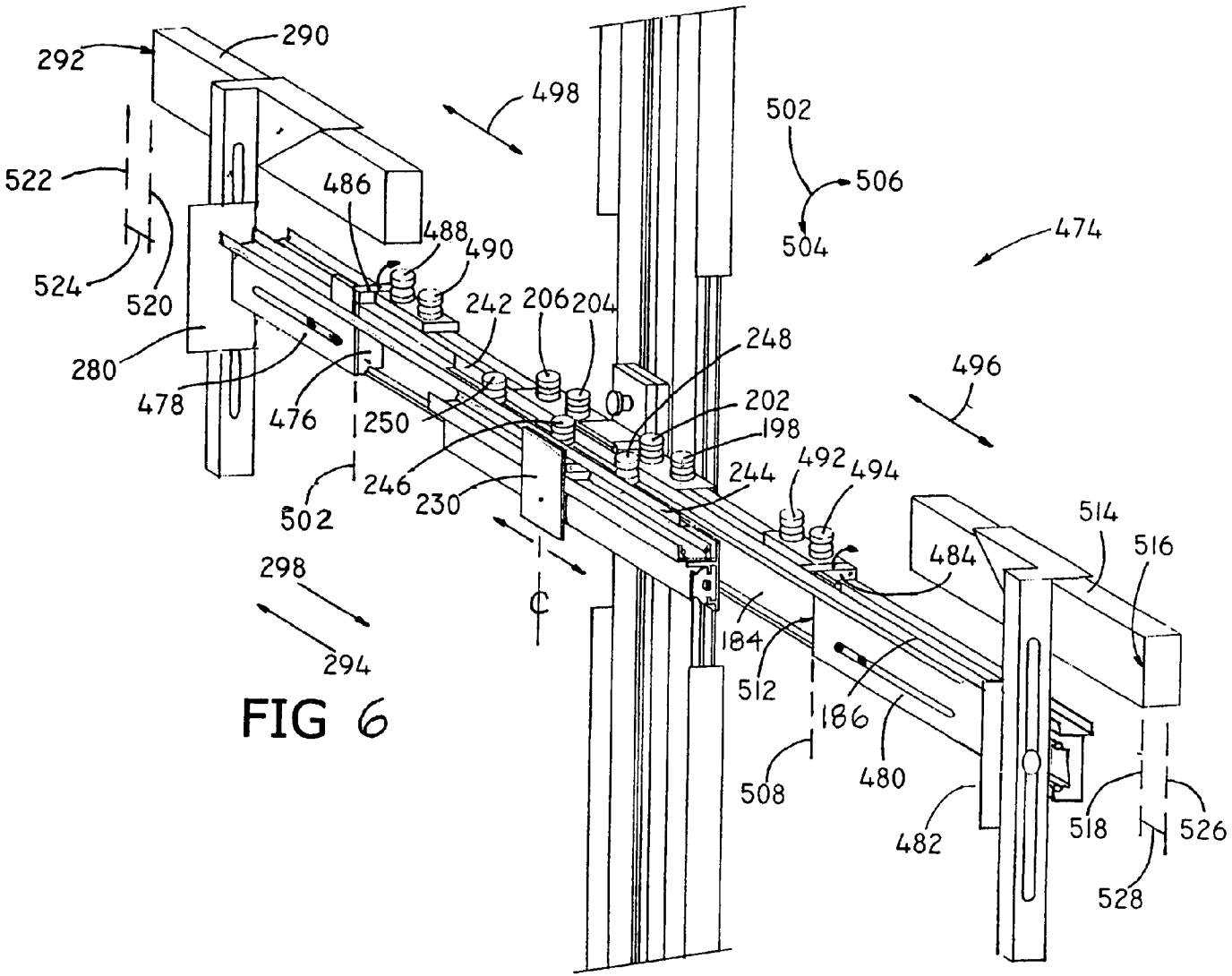
FIG. 6 is a detail view of another embodiment according to the invention suited to alignment of opposed structural surfaces, such as hallways and door openings.

Referring now to FIG. 6, another embodiment is shown which includes an additional configuration of the main Z-axis member E of the gantry system 10, which can be used to align parallel facing surfaces using the 3-axis X-Y-Z gantry system 10 of FIG. 1, or alternatively used in a 2-axis Y-Z configuration for measuring door openings for spacers, generally designated 474.

The embodiment of FIG. 6 allows extension of range and adjustability of the main Z-axis and bi-directional measuring of parallel surfaces, hallways, doorways, etc. In this regard, there are two different specifications regarding parallel surfaces. A first relates to parallel walls in which the distance between them when aligned is not critical, such as for example a hallway, and a second relates to parallel sides of a door frame, in which the distance between the shims (spacers) is critical, since the door frame must fit in a parallel opening of predetermined width. For example, a 30" wide door would typically have a 31¾" outside dimension of the door frame. Therefore the distance between the shims would have to be 31¾" in order for the door to fit. The device of FIG. 6 can be used in both of the aforementioned applications.

As shown in FIG. 6 the device 474 includes a second read head 514, located at an opposite end of main Z-axis E, having a leading end 516 for contacting a surface to be aligned which faces that measured by read head 290.

While the first and second read heads 290 and 514 could conceivably be mounted to a suitably dimensioned main Z-axis guide E in fixed condition relative to the Z-axis, i.e., such that they are movable along with slidable movement of linear guide rail 184 and so as to space apart leading ends 292 and 516 by the desired distance, for instance, 31¾" in the example, a more advantageous embodiment allows a full range of adjustability of distance between read heads 290 and 514, while improving performance when taking measurements.

Figure 7:
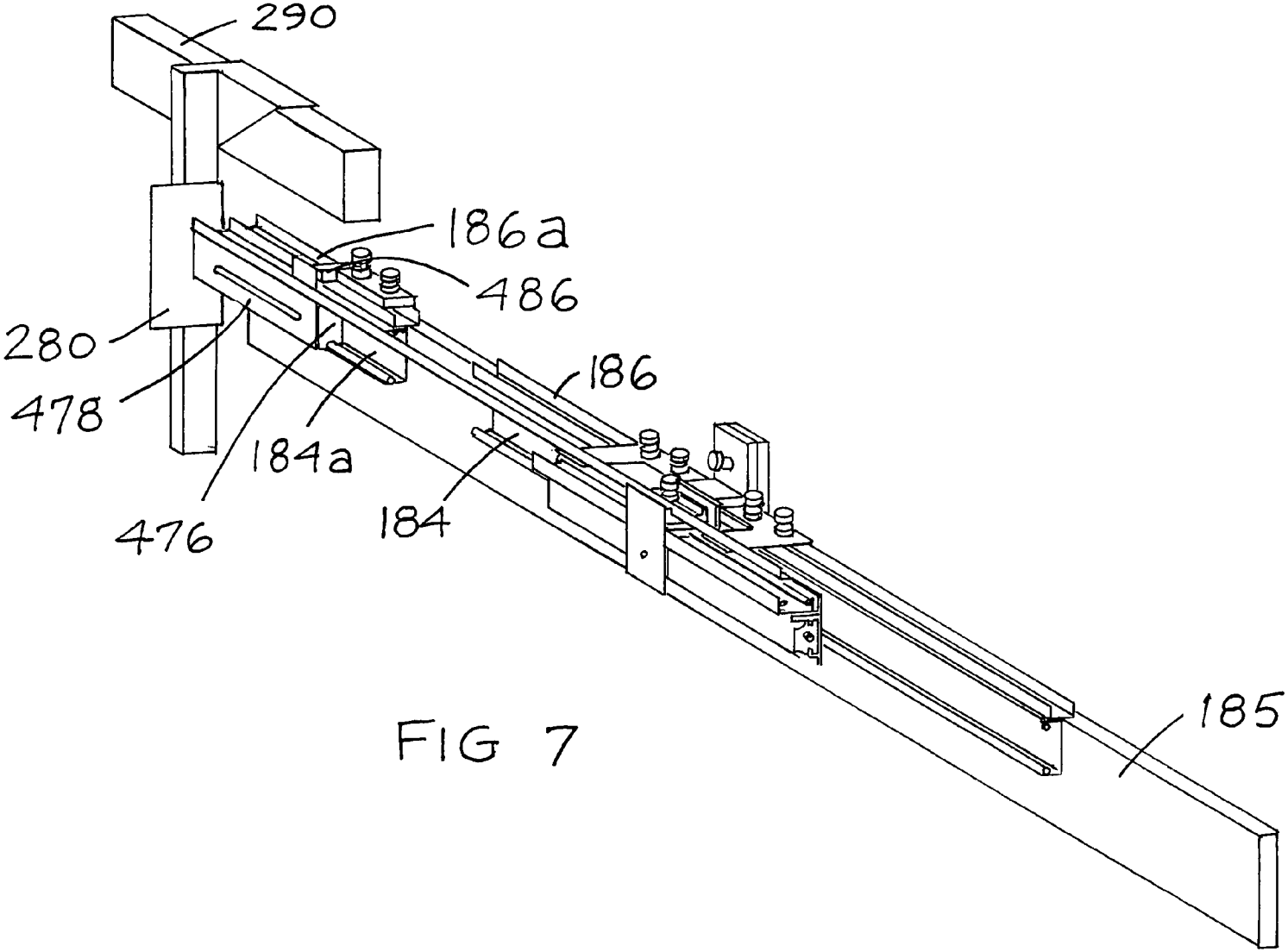
FIG. 7 is a detail view showing attachment of extension members to main Z-axis guide of FIG. 6.

In this case, extension of range, where desired, is accomplished by simply adding an extension member behind the Z-axis linear guide rail 184 of FIG. 4. As shown in FIG. 5, a space is present between Z-axis linear guide rail 184 and the connector bracket 164 just below T-channel 186. Thus, for example, if the Z-axis linear guide rail 184 (FIG. 4) were 4 feet long, a linear guide rail extension member 185 could be added, allowing a longer reach (see FIG. 7). As shown in FIG. 7, in accordance with the depicted configuration, a small section of each of the linear guide rail 184 (linear guide rail extension 184*a*) and the T-channel 186 (T-channel extension member 186*a*) can be added at the end of the extension member 185, to which the read head assembly 490, 488, 486, 476, 478, 280, 290 can be slidably installed via a linear guide slider 476 which rides in linear guide rail extension member 184*a* behind a plate 478 connected to a connecting plate 280 attached to read head assembly 490, 488, 486, 476, 478, 280, 290. Analogously, for second read head 514 (omitted for clarity of illustration), a linear guide slider (not visible in FIG. 6, but structurally the same as linear guide slider 476) is attached behind a plate 480 connected to a connecting plate 482 for holding the second read head assembly 494, 492, 484, 512, 480, 482, 514 to the linear slider which runs in the second linear guide rail extension member (not shown in FIG. 7). Such slidable mounting of the two red heads 290, 524 allows respective movement in the directions of arrows 498 and 496.

As a result of this augmentation, a longer angle motion transfer member 244 (or 242), long enough to span the increased distance occasioned by the addition of the extension member 185, is used to connect connector plate 280 to saddle 236, such that movement of read head 290 is transmitted to the magnet 220. Similarly, a longer angle motion transfer member 242 (or 244), also long enough to span the increased distance occasioned by the addition of the extension, is used to connect a connector plate 482 to saddle 236, such that movement of a second read head 514 is transmitted to the magnet 220 by the other of angle motion transfer members 242, 244, not already used for connection between connector plate 280 to stop plate 208. By using one of the angle motion transfer members 242, 244 for the connection between connector plate 280 to saddle 236, and the other for connector plate 482 to saddle 236, it is possible to readily adjust a distance between leading end 292 and leading end 516 by sliding each of the angle transfer members 242, 244 past one another in opposite directions at the saddle 236, and to secure each by tightening of fastener knob 246 which serves to mutually affix both to one another and the saddle 236.

It is noted that such approach of slidable mounting of a read head to an extension linear guide rail can be applied analogously also to the embodiment of FIG. 1, when, for example, it is desired that the frame of the gantry system 10 be spaced apart from the surface being worked on beyond the normal reach of main Z-axis guide E.

When the read heads 290, 514 are so mounted to the linear guide rail extension 184*a* and the second linear guide rail extension member (not shown), they move together, by being connected via angle motion transfer members 242, 244. As such, when using the device in this manner, linear guide rail 184 is secured against Z-axis movement, conveniently by abutting both stop plates 208, 210 against bridge/stop member 178. Movement of angle motion transfer members 242, 244 (and therefore also the read heads 290, 514) is then permitted by loosening fastener knobs 248, 250.

It is noted that this read head adaptation (slidable mounting on an extension rail) can be used on one end or both ends of the main Z-axis for use in halls or rooms. To shim doors, only the main Y-axis guide D with extendible I-beam assembly described above and the main Z-axis armature E are used. In such case, main Y-axis is simply rendered plumb between the sides of the door opening and fixed by suitable known means to the header and/or floor to maintain a stable plumb condition.

In use, and as shown in FIG. 6, T-nut assemblies 488, 490, 492, 494, are conveniently employed to securably locate a pair of adjustable flip stops 486 and 484 (which can flip in a manner shown at 502 to open in a direction of curved arrows shown in FIG. 6, from a closed position 504 and an open position 506), allowing the setting of distance between dotted lines 520 and 518. In the example of a 30" door, this distance between dotted lines 520 to 518 is set to 31¾". Next, angle motion transfer members 242 and 244 are connected to connector plate 230 in its center position ℄ and fastener knob 246 is tightened connecting read heads 290, 514 each via a respective one of angle motion transfer members 242, 244. With flip stops 484 and 486 in the down position, as indicated by arrow 504, this is a "zero" position with plate 230 centered on ℄ and a distance which opposed leading ends 292, 516 are apart is set to 31¾". By lifting stop 486, measurements can be taken in the direction of arrow 298, with fastener knobs 248, 250 loosened to allow slidable motion of angle motion transfer members 242 and 244 and magnet 220 attached thereto relative to probe 218. With flip stop 486 down and flip stop 484 lifted, measurements can be taken in the direction of arrow 294.

Fastener knobs 206, 204, 202, 198 are used to set the entire armature right-left to locate the 31¾" setting in order to locate the door frame. The order of use is: (1) a distance between dotted lines 518 and 520 (i.e., the equivalent distance between leading ends 292, 516 of opposed read heads 290, 514) is set to 31¾", (2) the vertical I-beam member is set plum in a door opening, and fastened to the door header, (3) the Z-axis is set right-left to position the intended location of the door, and (4) then measuring can be done on both sides.

The linear displacement probe 218 (FIG. 4) advantageously has a "re-zero on the fly" function which is employed to measure in either direction from any point along the sensing area of probe 218 between line 224 and 226 (shown in FIG. 4). This allows measuring in two directions as well as measuring in two modes, as discussed below in greater detail.

Figure 8:
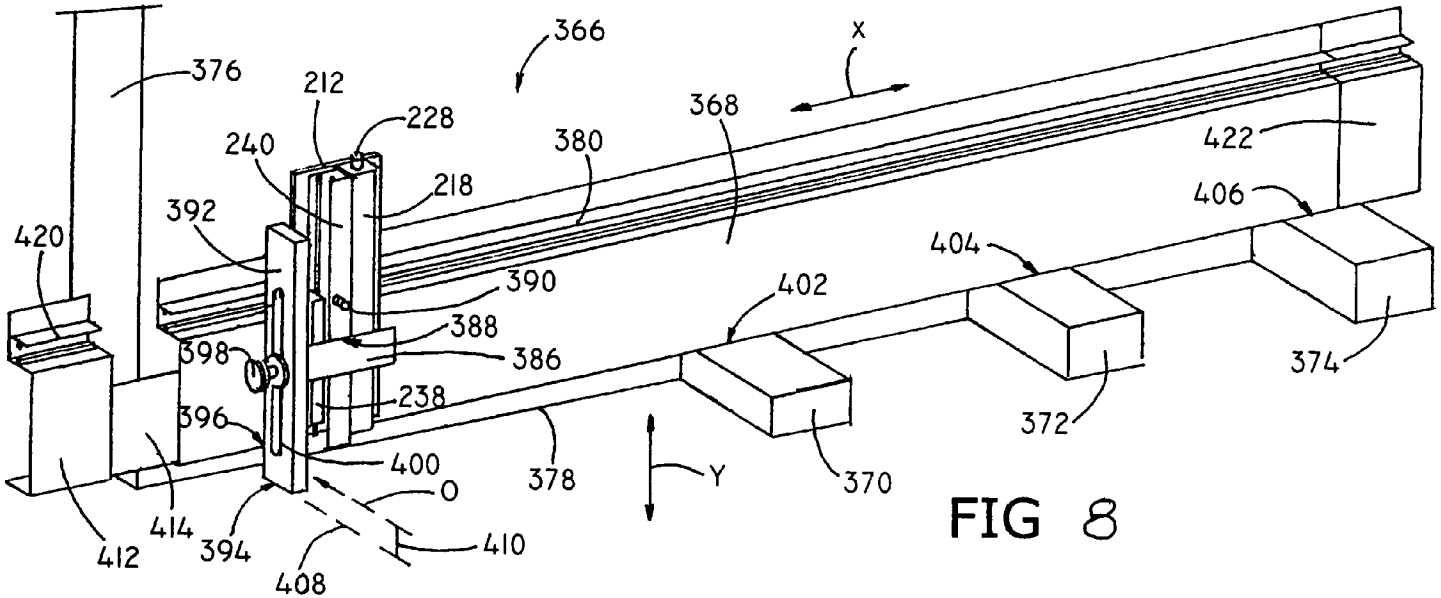
FIG. 8 is a front perspective view of another embodiment of the invention comprising a two-axis measuring device, suitable, for example, in shimming lower cabinets and surfaces above stairs.
Figure 9:
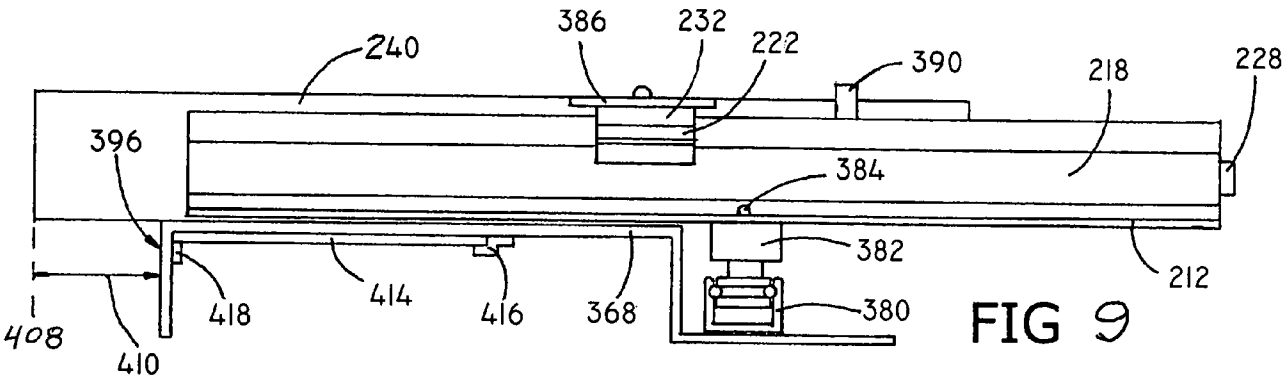
FIG. 9 is an end view of the embodiment of FIG. 8.

Turning now to FIGS. 8 and 9, another embodiment according to the invention is shown, and which is directed to 2-axis measuring device used, for example, in an application directed to shimming lower cabinets level next to a wall 376 (which meets a floor at 378).

The device, generally referred to at 366, includes a straight edge main member 368 having a surface 396 that is ground to linear straightness, and which serves as a single axis reference surface from which to measure relative thereto.

An adjustable read head member 392 serves as a measurement portion which is set in a "zero" position when a leading end 394 is aligned with straight edge surface 396. In this position, a stop plate 386 is adjusted to abut, at an edge 388, a fixed stop pin 390, which provides a zero stop point from which to reference. A fastener knob extending through a slot 400 is tightened, while leading end 394 is aligned with straight edge surface 396 and stop plate abutting stop pin 390.

Linear guide rail 240 and linear guide slider 238 are provided to guide Y-axis travel of the read head member 392 relative to probe 218. Magnet assembly 222 mounted conveniently by means of a channel member 232, moves along with the read head 392 to interact with probe 218 for generation of displacement data, as in the previous embodiments.

FIG. 8 shows main member 368 resting at points of contact 402, 404, 406 on spacers 370, 372, 374 which have been cut to size and installed in preparation of aligning something level. Straight edge surface 396 is aligned with the spacers 370, 372, 374, creating a reference to measure in the Y-axis, at points along the X-axis.

Measurements can be taken at locations between two points, such as the location of spacer 372, or measurements can be taken outside or beyond an established line or field of spacers 370, 372, 374 shown by the location of read head member 392.

The electronics mount 212 (FIG. 8) is the same as that described with reference to FIGS. 4 and 5, which is advantageously, thereby, interchangeable between the gantry system 10 of FIG. 1 and 2-axis device 366 of FIGS. 8 and 9, and includes probe 218 with connector 228. Electronics mount 212, including probe 218, is advantageously removably affixed to main member 368 conveniently by a screw 384.

The electronics mount 212 is connected to an X-axis linear guide slider 382 (FIG. 9), and which rides in an X-axis linear guide rail 380, allowing generally horizontal travel over the length of main member 368, and maintaining a condition of parallel to the straight edge surface 396. Therefore, read head member 392 can maintain alignment of leading edge 394 and straight edge surface 396. Linear guide slider 382 can travel onto an extension member 412, 422 (FIG. 8) having a linear rail extension 420, bridged to main member 368 by a bridging member 414, held in place by retainers 416, 418, providing a way to extend the range of main member 368.

The differential distance of travel between 396 and 408 is the thickness of the spacer 410.

Figure 10:
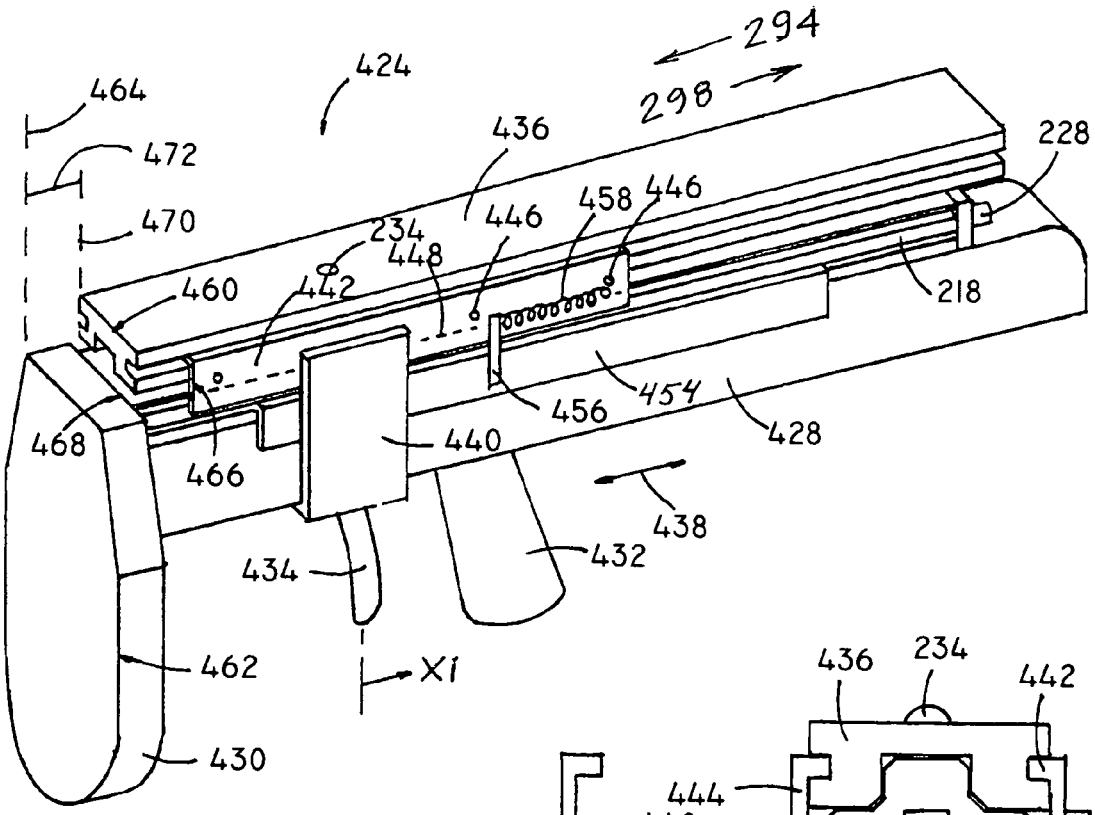
FIG. 10 is a front perspective view of another embodiment in accordance with the invention directed to portable device used in conjunction with a reference straight edge, such as a laser.

Another advantageous embodiment is directed to a portable device for taking hand-held measurements representative of differential distances between a reference plane spaced apart from a structural surface and local positions along the structural surface 9, and which is contemplated within the scope of the invention described herein. Turning now to FIGS. 10 and 11, a hand held single axis device 424 is depicted.

Device 424 includes a body 428 having linear displacement probe 218, with a connector 228 for outputting data, mounted thereto, conveniently by way of angles 452, 454. A magnet assembly 222 is slidably movable relative to probe 218 and includes magnet 220. Magnet assembly 222 is fastened to a read head member 436, conveniently by a screw 234. The assembled magnet assembly 222 and read head member is captively and slidably held to probe 218 by connector angles 442, 444 having projecting parts 448 that engage grooves 450 in probe 218.

A reference plate 430 is provided at an end of body 428 having a leading end surface 462 for contacting a structural surface.

A finger pull 434 connected to connector angle 442, 444 via a finger pull motion transfer plate 440, advantageously provides a convenient way to slide the read head member 436 relative to the body 428. Finger pull 434 is operated while advantageously hand-holding the device 424 by a handle 432.

A spring 458 connected between at least one of connector angles 442, 444 and a spring mount 456 attached to corresponding angles 452, 454, biases read head member 436 in a direction of a leading end surface 462 of reference plate 430, and opposite to a force applied to the finger pull 432.

As will be described below in greater detail, the device 424 can be used in two ways, either zeroing the device when a leading end 460 of the read head member 436 aligns with the leading end surface 462 of the reference plate 430 and then withdrawing the leading end 460 of the read head member 436 to a point of alignment with a reference plane 470 indicated by a laser, string or edge (as shown in FIG. 10, or alternatively zeroing the device when leading end 460 is aligned with the reference plane and allowing the spring biasing to move the read head member into confronting contact with the surface and alignment with the leading end surface 462 of the reference plate 430 by release of the finger pull 434. As noted above herein, the reference plane which is spaced apart and advantageously parallel to the wall or other surface can be defined by any suitable means including a string, laser a straight edge device or a simple straight edge made of wood or plywood which can be cut to specific length, thereby lending to flexibility of the device. Also a level can be used, etc.

Use of the above described embodiments are now discussed, with additional reference to FIG. 12, which depicts an automated cutting system 300.

Referring to FIG. 12, an automated system for cutting spacers (shims) in accordance with data measurement taken, for example, by the gantry system of FIG. 1, or the other described measurement devices, is shown generally at 300. The sizing of the spacers 302 is controlled by a stepper or servo 308 powered positioning system 306, which controls a linear guide slider 310 in the directions of 324/326. Most controls for communicating with the PLC are conveniently found on a control panel 356. Location of the PLC is not critical, and in the example of FIG. 12, is housed conveniently in the housing of control panel 356.

The spacers 302 are cut by a typical power miter saw 350. A saw blade 348 of miter saw 350 follows the path of dotted line 0 and cuts the spacers 302 which are optionally first numbered in order by a printer head 328. When cut, the spacers 302 fall through a chute 332/334 into a container 336, after which, spacers 302 are placed on the wall 12 shown in FIG. 1 (as mounted spacers 14).

Upon powering the system 300, the bearing carriage 310 is programmed to home to a position in which a leading end 312 thereof aligns with dotted line 322. This is the formed "zero" position. A wood marker 314 is connected to bearing carriage 310 by a bracket 316 and a fastening knob 318. The wood marker 314 is placed so an end thereof extends past the saw blade dotted line 0. Next, a saw cut is made through wood marker 314, cutting it even with dotted line 0. Thus, the leading end 320 of wood marker 314 is aligned with dotted line 0 of the saw blade 348, and the leading end 312 of bearing carriage 310 is aligned with dotted line 322 of the positioning system. Now the apparatus is "zeroed," meaning the 0 line of saw blade line 345 is coordinated with the bearing carriage 310 via the leading end 320 of wood marker 314. Now the printer head 328 is placed in alignment with the leading end 320. The system then ready to cut spacers 302 from spacer stock 304 comprising a solid material, such as wood block. The saw 350 moves downward and upward as indicated by arrows 354, which can be implemented either manually or automatically. A teach switch 352 can be optionally provided that allows incrementally transferring measurement information from a register of stored data for cutting spacers one at a time.

All spacers are sized by contact with the leading end 320 of wood marker 314 mechanically coupled with bearing carriage 310, and moving in a controlled manner in the direction 324 according to electronic measurement information from FIG. 1 (or the other embodiments) via the PLC or industrial computer, one at a time or in batches. Spacer stock 304 is advantageously automatically advanced to contact the wood marker by an auto feed device 340, 342, 344, 346. A rolling cart 338 is optionally provided to facilitate moving cutting system 300 around the job site.

It is noted that two basic modes of measuring are applicable within the intended scope of the invention, and for use in collecting cutting data for use in preparing the spacers as detailed above. These include: mode (1), measuring from a zero location, related to a fixed reference plane spaced apart from the structural surface, to the structural surface at the measurement location, and mode (2), measuring from the structural surface to the zero location.

An advantageous method of operation as applied to the example of FIG. 1 and according to mode (1) for the gantry system 10, includes setting a set switch 500 (FIG. 12) on a control panel 356 to L, which means linear displacement probe 218 (FIG. 4) is measuring positions in a direction of arrow 294. As seen in FIG. 1, a leading end 292 of read head 290 is aligned with line 0 (equals magnet alignment with ℄,). Then, leading end 292 of read head 290 travels in direction of arrow 294 to contact line 296 which is indicative of the wall 12, or structural surface or subsurface. Differential distance Z (FIG. 1) represents the desired thickness of spacer 14.

Mode (2) for the gantry system 10 includes setting the set switch 500 of the control panel 356 to R to measure in the direction of arrow 298. Again, as shown in FIG. 1, line 0 equals magnet alignment with ℄.Now leading end 292 of read head 290 is moved to contact the wall contact line 296, and zero switch 362 is activated. The PLC now recognizes that leading end 292 of read head 290, contacting contact line 296, as "zero." Then, leading end (confronting surface) 292 of read head 290 is moved to align with line 0, and in that position the learn button 262 or 264 (FIG. 4) is pushed. Again, Z (FIG. 1) equals the desired thickness of spacer 14. Thus, the probe monitors the relative positions (differential distances).

Use of mode (1) in connection with gantry system 10 is deemed advantageous over the remaining of the two choices described above, insofar as it is easier to take measurements. In particular, once leading end 292 of read head 290 is set to line 0, zero switch 362 need be activated only one time. Thereafter, leading end 292 of read head 290 can slide along the wall to each shim location and take measurements relative to the learned zero position at line 0. In this way, the leading end 292 of read head 290 does not have to return to the line 0 (zero position) each time a spacer (shim) location is measured.

To determine the proper thickness of spacers 14 of FIG. 1 using mode (1), the read head 290 is set so that the leading end indicated by arrow 292 is in alignment with the intended location of spacers 14 which is set back from chalk line 22 by the thickness of the paneling 18.

With leading end 292 in this position (and as shown in FIG. 1), stop plate 210 (FIG. 4), which is captively slidable along T-channel 186 when fastener knobs 204,206 are in a loosened condition, is locked in place against bridge/stop member 178 by tightening fastener knobs 204,206. Another knob 250 is tightened against angle motion transfer members 242, 244. Then, a knob 246 is tightened with connector plate 230 held in its location between locations 224 and 226. Knobs 198, 202, 248 are then loosened. Bridge/stop member 178 provides a stop for a stop plate 210, preventing withdrawal of leading edge 292 of read head 290 past its zeroed position aligned with the desired position of the spacers 14 and which, in the example, will be set back from chalk line 22 by the thickness of the paneling 18.

With the main Z-axis E having been set at the zero distance marker, as detailed above, the distance that the leading edge 292 travels in the direction of arrow 294 to contact the wall 12, as indicated by dotted line 296, is equal to the thickness of the intended spacer 14.

With the leading end 292 of read head 290 calibrated at zero, as described, cutting system 300 (FIG. 12) is powered on, and homed, as described. The control panel 356 can be set as follows. A switch 358 is set to "AUTO" and another switch 360 is set to "MEASURE." Set switch 500 is set to "L" such that the linear displacement probe 218 (FIG. 4) is measuring positions in a direction of arrow 294.

Now, with stop plate 210 held against bridge/stop 178 (FIG. 4), the zero switch 362 is activated, which zeroes the probe 218, calibrating same with the "homed" 0 position of the positioning system 306. The alignment of saw blade 348, dotted line 0 and a leading edge 320 of stop member 314 (FIG. 12) are coordinated the "zero" position of the leading end 292 of read head 290, 0 in relation with intended surface of spacers 14 (FIG. 1). The system is then ready to measure intended locations on the wall 12 for spacers 14.

Handles 258, 260, shown FIGS. 4 and 5, advantageously allow an operator to move main Z-axis guide E in X and Y-axis directions to access the wall 12 with leading end 292 of read head 290. The operator contacts the wall 12 with the leading end 292 of the read head 290 at the locations where the spacers are intended, such as along horizontal layout lines 16 in any order desired by the operator. Each location can conveniently be numbered on the wall 12, advantageously in order, e.g. 1, 2, 3, 4, 5, etc., so the operator has a way of keeping track of spacer locations.

The operator contacts each location with the leading end 292, and activates either learn button 262 or 264 (FIG. 4) depending on convenience based upon a height location of the main Z-axis guide E. This is a "learn" function which will store measurement data which will later be used to "teach" in the cutting step. The probe communicates information via connector 228 on probe 218 to the PLC in the order of each location.

The dimensions are recorded then on register 1, 2, 3, 4, 5, 6, etc., until a batch of measurements have been taken. Then they are cut in the same order.

The use of device FIG. 8 is the same as the gantry system 10, except that the "zero" reference is the surface of aligned existing spacers, vertically or horizontally. However, it can be used without existing spacers, in which case operation is analogous to that previously described.

Regarding the hand-held device 424 of FIG. 10, operation is different from that described above, only in that the preferred method relative thereto is to measure from the subsurface or wall to an aligned reference plane, provided external of the device in the form of a string, a laser, aligned edge, etc. (i.e., mode (2)).

Figure 11:
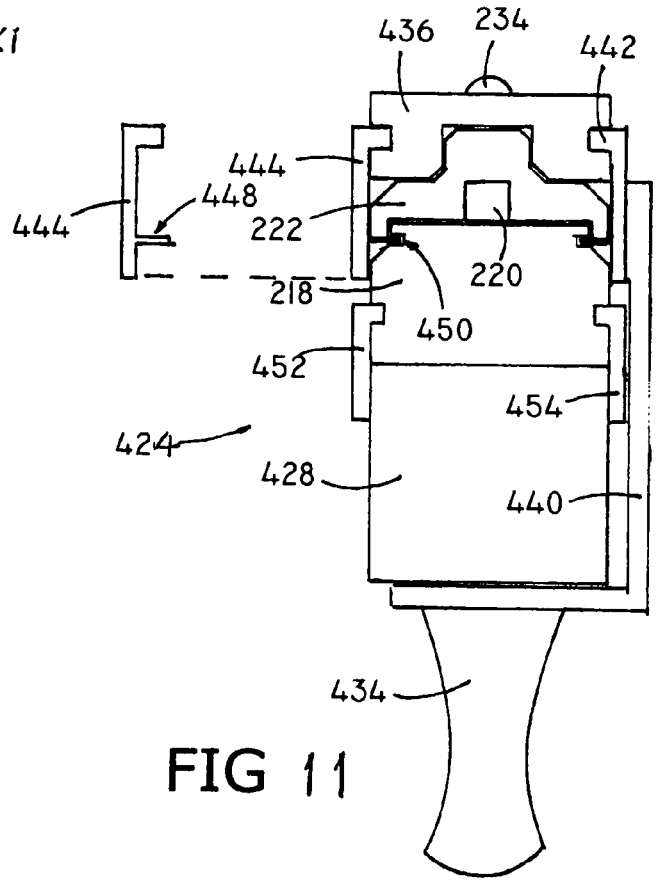
FIG. 11 is cross-sectional view taken along line XI in FIG. 10.
Figure 12:
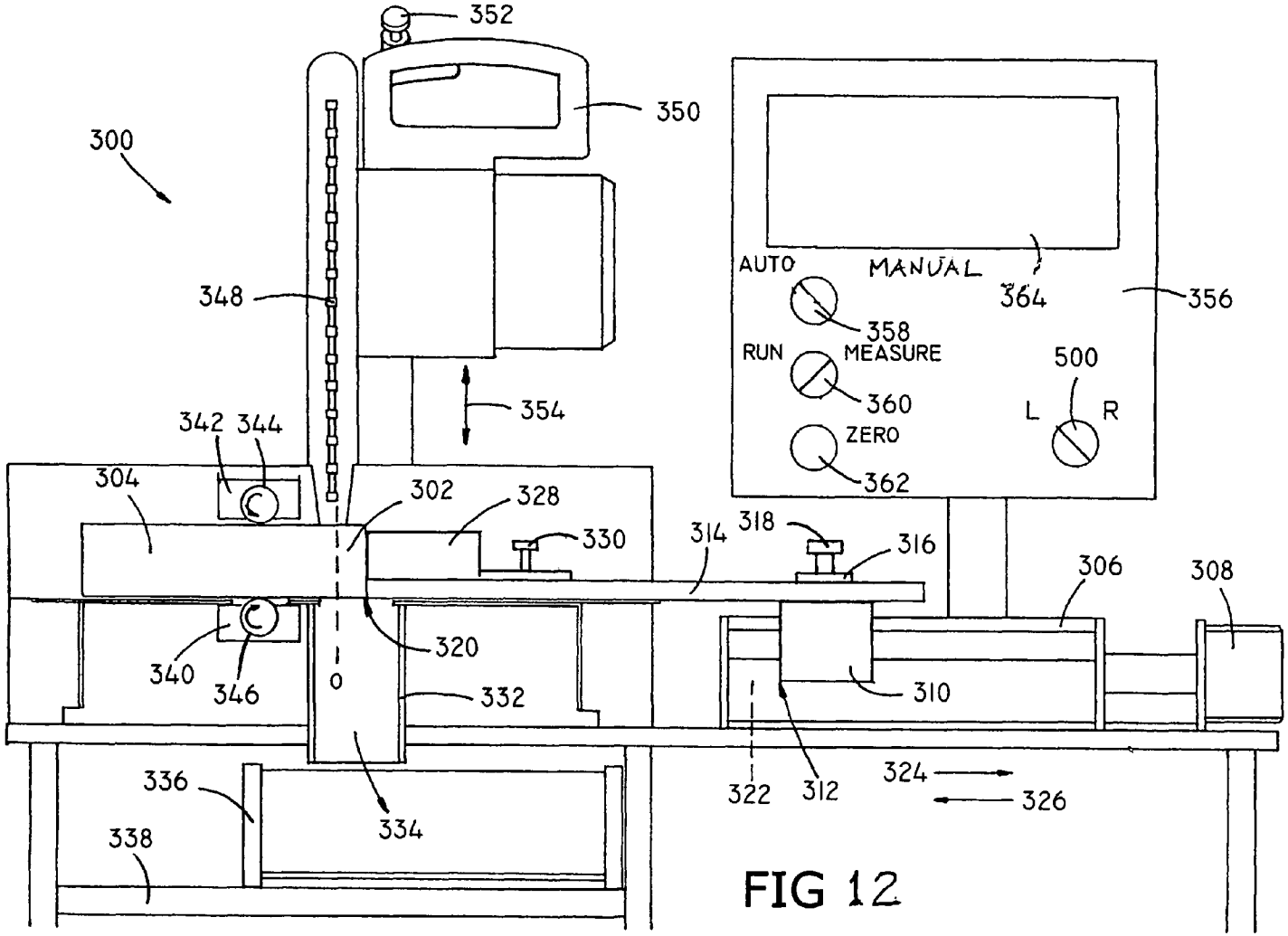
FIG. 12 is a schematic view of an automated system for cutting spacers (shims) in accordance with data measurement taken by the measurement apparatus of FIG. 1 in accordance with an embodiment of the invention.

With the configuration of the portable device 424 of FIG. 10 and 11, a "zero" setting of the device is advantageously when the leading end 460 of read head member 436 is aligned with leading end surface 462 of reference plate 430. In this position, zero switch 362 (labeled ZERO in FIG. 12) is activated, coordinating ZERO line 464 of the device 424 with line 0 of FIG. 12. The control panel is set with the set switch 500 switched to R, controlling the probe 218 to measure in the direction of 298, away from the wall or subsurface to line 470. The distance labeled 472 represents the thickness of the spacer to be cut.

A second mode, is to switch the set switch 500 of the control panel 356 to L, which changes the probe 218 to measure in a direction 294. In this mode, line 470 becomes ZERO, and line 464 is the differential measurement position.

When used in a first measurement mode, "zero" of the device is when the leading end 460 of a read head member 436 is aligned with a front surface 462 of a reference plate 430. In this position, zero switch 362 (labeled "ZERO" in FIG. 12) is activated, coordinating a ZERO line of the device indicated by dotted line 464 with line 0 in FIG. 12. The control panel 356 of FIG. 12 is set with set switch 500 switched to R, controlling the probe 218 to measure in the direction of arrow 228, away from the wall or subsurface to line 470. 472 is the thickness of the spacer.

The device 424 is set up by adjusting a read head member 436 with a leading end 462 aligned with surface 462 shown by line 464. In this position the device is set to a "zero" position. The leading end 466 of 422 acts as a positive stop against 430 arrow 468. This maintains a ZERO position of alignment of 460 with 464.

The device is used by placing the surface 462 shown by line 464 against a structural surface to be aligned. In this position the finger pull 434 is pulled toward handle 432 to align 460 with 470 which represents a string, laser, or edge.

As mentioned above, while the various measurement device embodiments described herein differ structurally and functionally in certain respects from one another, the procedure for cutting the spacer based upon the differential Z-axis distance measurements is applicable to each.

The cutting procedure can be done in 2 modes: (1) A batching process after a group of measurements have been taken (2) the cutting station is fully automated to cut spacers as they are measured in a "follow behind" process.

Having described above various measurement and spacer formation embodiments, it will be understood that in broad terms, measurement of Z-axis variations of a structure to be aligned is accomplished in all embodiments described herein by determination of differential distance measurements between the structural surface at various locations therealong and a fixed reference plane spaced apart from the structural surface. While it is deemed particularly advantageous to employ a electronic linear transducer (for example magnetostrictive) for measuring linear displacement of a read head having a measurement portion which is advanceable and retractable relative to the structural surface and including a confronting front surface contactable with the structural surface when advanced, any suitable mechanism for measuring an amount of relative linear displacement from measurement location to reference plane is contemplated to be within the scope of the invention.

For example, in the portable device embodiment of FIGS. 10 and 11, instead of using a linear displacement transducer, a simple graduated rule could be provided on a side of the body 428 the that would indicate a travel distance of the read head member 436 representative of differential displacement. These readings could then be transferred manually to set a distance that the spacer stock extends beyond the cutting blade.

It is further noted that, in all of the above described measurement embodiments, the magnet moves relative to a stationary probe. However, it will be understood that a probe could alternatively be suitably mounted for movement following that of the read head, relative to a stationary magnet. It is also conceivable that both the probe and the read head could be mounted, both for movement at different relative rate of travel, the net relative movement therebetween being indicative of the differential distance to be measured. Therefore, all that is necessary is that a relative distance traversed by the probe and magnet is representative of, or predictably related to, a differential distance being measured by the read head.

Finally, the reference plane need not be a plane representative of the outer facing surfaces of the spacers when mounted (spacer plane). Rather, it is entirely possible to measure relative to a reference plane spaced apart from the desired spacer plane, and then add or subtract a separation distance between the respective planes prior to cutting the spacers to account for the difference. For this reason, the disclosure uses the term "based upon" in referring to the differential distance between reference plane and surface, rather than necessarily being "equal to" such distance. Stated in other words, the reference plane is said to have a "fixed relationship with" the spacer alignment plane.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method of shimming a structural surface, comprising:

defining a reference plane in a fixed condition relative to the structural surface, said reference plane being spaced apart from said structural surface, a respective distance of said spacing being different at least a first position and a second position along the structural surface;

providing a measuring device comprising a reference portion fixable in relation to said reference plane and a measurement portion, said measurement portion being operable, by movement relative to said reference portion, to ascertain a differential distance between said structural surface and a reference position of said reference portion which is coincident with, or has a predetermined spacing from, said reference plane;

locating said measurement portion at said first position along the structural surface;

fixing said reference portion in a predetermined relation to said reference plane at said first position;

operating the measurement portion to take a first differential distance measurement representative of the respective distance of said spacing present between the structural surface and the reference position of the reference portion at the first position to determine a first differential distance;

relocating the measurement portion at said second position along the structural surface;

fixing said reference portion in said predetermined relation to said reference plane at said second position;

operating the measurement portion again to take a second differential distance measurement representative of the respective distance of said spacing present between the structural surface and the reference position of the reference portion at the second position to determine a second differential distance; and preparing a first spacer having a thickness based upon said first differential distance and a second spacer having another thickness different from said first thickness based upon said second differential distance.

2. A method according to claim 1, further comprising mounting said first and second spacers respectively at said first and second locations.

3. A method according to claim 1, wherein said operating the measurement portion and said operating the measurement portion again respectively to directly take the first and second differential distance measurements each includes contacting the structural surface with a leading end of both the reference portion and the measurement portion at each of the first and second positions and measuring a distance traversed at each of the first and second positions when the leading end of the measurement portion is withdrawn to the reference position while the leading end of the reference portion remains in contact with the structural surface at a respective one of said first and second positions, said distance representing each of the first and second differential distances, respectively.

4. A method according to claim 1, wherein said operating the measurement portion to take the first differential distance measurement and said operating the measurement portion again to take the second differential distance measurement each includes measuring a distance traversed when a leading end of said measurement portion is advanced from the reference position to contacting engagement with the structural surface.

5. A method according to claim 1, wherein said defining a reference plane in a fixed condition relative to the structural surface includes fixing a gantry in a spaced apart generally parallel condition with the structural surface, said reference portion being carried on said gantry.

6. A method of shimming a structural surface, comprising:

defining a reference plane in a fixed condition relative to the structural surface;

locating a measurement portion of a measuring device at a first position along the structural surface;

taking a first differential distance measurement between the structural surface and the reference plane at the first position to determine a first differential distance;

relocating the measurement portion at a second position along the structural surface;

taking a second differential distance measurement between the structural surface and the reference plane at the second position to determine a second differential distance;

preparing a first spacer having a thickness based upon said first differential distance and a second spacer having a thickness based upon said second differential distance;

providing a second measurement portion of a second measuring device along a horizontally level connecting axis one of common with or parallel to the measurement portion of the measuring device;

spacing apart a first leading end of the measurement portion and a second leading end of the second measurement portion in an X-axis direction a desired distance for alignment of the structural surface and an other structural surface spaced apart from and facing the structural surface;

locating the second measurement portion at a third position along the other structural surface;

taking a third differential distance measurement at said third position between the other structural surface and an other reference plane, the other reference plane being coincident with the second leading end when the first leading end is aligned with the reference plane;

relocating the second measurement portion at a fourth position along the other structural surface; and taking a fourth differential distance measurement between the other structural surface and the other reference plane at the fourth position.

7. A method, of shimming a structural surface, comprising:

defining a reference plane in a fixed condition relative to the structural surface;

locating a measurement portion of a measuring device at a first position along the structural surface;

taking a first differential distance measurement between the structural surface and the reference plane at the first position to determine a first differential distance;

relocating the measurement portion at a second position along the structural surface;

taking a second differential distance measurement between the structural surface and the reference plane at the second position to determine a second differential distance; and preparing a first spacer having a thickness based upon said first differential distance and a second spacer having a thickness based upon said second differential distance, said preparing including advancing a spacer stock to contact a gate which is spaced from a cutting blade a distance based upon each of said first and second distances.

8. An apparatus for taking measurements for spacers to be mounted to a structural surface for leveling thereof, comprising:

a device or structure defining a specified reference plane oriented in fixed spaced apart relation to the structural surface;

a measurement portion which is locatable at positions along the structural surface at which the spacers are to be mounted, said measurement portion being operable for advancement and retraction relative to the structural surface and including a leading end contactable with the structural surface when advanced, and alignable with said reference plane when retracted; and a reference portion to which said measurement portion is movably mounted and against which a particular distance traversed by said measurement portion by said advancement and retraction is measurable at each of said positions along the structural surface at which the spacers are to be mounted, said reference portion being fixable relative to the reference plane, at least while each of said measurements are being taken at each of said positions along the structural surface at which the spacers are to be mounted.

9. An apparatus according to claim 8, further comprising a displacement indicator which indicates said particular distance traversed by said measurement portion by said advancement and retraction, such that a differential distance between a position in which the leading end is in contact with the structural surface and another position in which the leading end is aligned with the reference plane is determinable and upon which a thickness of each of said spacers is based.

10. An apparatus according to claim 8, wherein said reference portion is fixable relative to the reference plane by engaged contact of a forward surface of said reference portion with said structural surface respectively at each of the positions along the structural surface at which the spacers are to be mounted.

11. An apparatus for taking measurements for spacers to be mounted to a structural surface for leveling thereof, comprising:

a reference portion fixable in an orientation relative to the structural surface;

a measurement portion mounted to said reference portion such that said measurement portion is locatable at positions along the structural surface at which the spacers are to be mounted, said measurement portion being advanceable and retractable relative to the structural surface and including a leading end contactable with the structural surface when advanced; and a displacement indicator indicating a distance between a position in which the leading end is in contact with the structural surface and another position in which the leading end is aligned with a reference plane spaced apart from said structural surface, said displacement indicator comprising a linear displacement probe.

12. An apparatus for taking measurements for spacers to be mounted to a structural surface for leveling thereof, comprising:

a reference portion fixable in an orientation relative to the structural surface said reference portion including a gantry frame locatable generally parallel with and spaced apart from said structural surface, said gantry frame including bilateral vertical braces and bottom and top X-axis guides;

a measurement portion mounted to said reference portion such that said measurement portion is locatable at positions along the structural surface at which the spacers are to be mounted, said measurement portion being advanceable and retractable relative to the structural surface and including a leading end contactable with the structural surface when advanced, said measurement portion further including a Y-axis guide slidably mounted to said gantry frame for location thereof along an X-axis direction to positioned between the vertical braces, said measurement portion further including a Z-axis guide mounted to said Y-axis guide carrying a read head at an end thereof, said read head being advanceable and retractable relative to the structural surface; and a displacement indicator indicating a distance between a position in which the leading end is in contact with the structural surface and another position in which the leading end is aligned with a reference plane spaced apart from said structural surface.

13. An apparatus according to claim 12, wherein said bilateral braces and said Y-axis guide are height adjustable.

14. An apparatus according to claim 12, wherein said bottom and top X-axis guides each includes a first portion mounted in a fixed condition relative to the structural surface and a second portion slidably mounted to the first portion, thereby allowing the gantry frame to be slidably located along the X-axis while remaining in a fixed relationship with the structural surface in the Z-axis.

15. An apparatus according to claim 12, further comprising brackets installable to the structural surface to which the gantry frame is attachable.

16. An apparatus according to claim 12, wherein the Z-axis guide is slidable relative to the Y-axis guide.

17. An apparatus according to claim 12, wherein the read head is slidable relative to the Z-axis guide.

18. An apparatus according to claim 17, wherein the read head is slidably mounted to an extension to the Z-axis guide.

19. An apparatus for taking measurements for spacers to be mounted to a structural surface for leveling thereof, comprising:

a reference portion fixable in an orientation relative to the structural surface;

a measurement portion mounted to said reference portion such that said measurement portion is locatable at positions along the structural surface at which the spacers are to be mounted, said measurement portion being advanceable and retractable relative to the structural surface and including a leading end contactable with the structural surface when advanced; and a displacement indicator indicating a distance between a position in which the leading end is in contact with the structural surface and another position in which the leading end is aligned with a reference plane spaced apart from said structural surface, said reference portion includes a Y-axis guide mounted in a fixed condition to the structural surface and an other structural surface facing said structural surface and spaced apart therefrom; and said measurement portion includes a Z-axis guide mounted to said Y-axis guide, said Z-axis guide carrying a first read head at first an end thereof and a second read head on a second end thereof, said first read head being advanceable and retractable relative to the structural surface, and a second read head being advanceable and retractable relative to the other structural surface, a distance of spacing between respective leading ends of the first and second read heads being adjustable to correspond with a desired shimmed spacing between the structural surface and the other structural surface.

20. An apparatus for taking measurements for spacers to be mounted to a structural surface for leveling thereof, comprising:

a reference portion fixable in an orientation relative to the structural surface;

a measurement portion mounted to said reference portion such that said measurement portion is locatable at positions along the structural surface at which the spacers are to be mounted, said measurement portion being advanceable and retractable relative to the structural surface and including a leading end contactable with the structural surface when advanced, said measurement portion including a read head member slidably mounted to a body, said body including a front end for contacting a structural surface, said read head including a leading end for contacting the structural surface when aligned with the front end, and said reference portion being separate of said measurement portion and including a reference plane indicator against which an alignment of said leading end can be judged; and a displacement indicator indicating a distance between a position in which the leading end is in contact with the structural surface and another position in which the leading end is aligned with a reference plane spaced apart from said structural surface.

21. An apparatus according to claim 20, wherein said reference plane indicator is one of a laser, a string and a straight edge.

22. An apparatus for taking measurements for spacers to be mounted to a structural surface for leveling thereof, comprising:

a reference portion fixable in an orientation relative to the structural surface, said reference portion including a straight edge main member having a linear straight surface serving as a single axis reference surface from which to measure relative thereto;

a measurement portion mounted to said reference portion such that said measurement portion is locatable at positions along the structural surface at which the spacers are to be mounted, said measurement portion being advanceable and retractable relative to the structural surface and including a leading end contactable with the structural surface when advanced, said measurement portion including an adjustable read head member which is zeroed when a leading end of the read head member is aligned with the linear straight surface; and a displacement indicator indicating a distance between a position in which the leading end is in contact with the structural surface and another position in which the leading end is aligned with a reference plane spaced apart from said structural surface.

* * * * *